US009199108B2

(12) United States Patent
Guo et al.

(10) Patent No.: US 9,199,108 B2
(45) Date of Patent: Dec. 1, 2015

(54) FIRE EXTINGUISHING COMPOSITION GENERATING FIRE EXTINGUISHING SUBSTANCE THROUGH HIGH-TEMPERATURE DECOMPOSITION

(71) Applicant: XI'AN J&R Fire Fighting Equipment Co., Ltd, Xi'an (CN)

(72) Inventors: Hongbao Guo, Xi'an (CN); Honghong Liu, Xi'an (CN); Xiaoqing Zhao, Xi'an (CN)

(73) Assignee: XI'AN J&R Fire Fighting Equipment Co., Ltd., Shaanxi (CN)

( * ) Notice: Subject to any disclaimer, the term of this patent is extended or adjusted under 35 U.S.C. 154(b) by 0 days.

(21) Appl. No.: 14/638,740

(22) Filed: Mar. 4, 2015

(65) Prior Publication Data

US 2015/0174439 A1 Jun. 25, 2015

Related U.S. Application Data

(63) Continuation of application No. 13/824,123, filed as application No. PCT/CN2011/079429 on Sep. 7, 2011, now abandoned.

(30) Foreign Application Priority Data

Sep. 16, 2010 (CN) ..... 2010 1 0285531

(51) Int. Cl.

| | |
|---|---|
| ***A62D 1/06*** | (2006.01) |
| ***A62C 35/02*** | (2006.01) |
| ***A62C 13/02*** | (2006.01) |
| ***A62C 5/00*** | (2006.01) |
| ***A62C 31/02*** | (2006.01) |

(52) U.S. Cl.

CPC . *A62D 1/06* (2013.01); *A62C 5/006* (2013.01); *A62C 13/02* (2013.01); *A62C 31/02* (2013.01); *A62C 35/023* (2013.01)

(58) Field of Classification Search

CPC ..... A62D 1/06

See application file for complete search history.

(56) References Cited

U.S. PATENT DOCUMENTS

| | | | | |
|---|---|---|---|---|
| 2,901,428 | A | 8/1959 | Schulenburg | |
| 3,017,348 | A | 1/1962 | Schulenburg et al. | |
| 4,207,245 | A | 6/1980 | Halbert | |
| 5,055,208 | A | 10/1991 | Stewart et al. | |
| 5,071,076 | A | 12/1991 | Chagnon et al. | |
| 5,423,385 | A | 6/1995 | Baratov et al. | |
| 5,466,386 | A | 11/1995 | Stewart et al. | |
| 5,613,562 | A | 3/1997 | Galbraith et al. | |
| 5,831,209 | A * | 11/1998 | Kozyrev et al. | 149/21 |
| 6,042,664 | A * | 3/2000 | Kozyrev et al. | 149/109.6 |
| 8,652,346 | B2 * | 2/2014 | Guo et al. | 252/5 |
| 8,865,014 | B2 | 10/2014 | Guo et al. | |
| 8,871,110 | B2 | 10/2014 | Guo et al. | |
| 2003/0197159 | A1 | 10/2003 | Kinase et al. | |
| 2007/0018143 | A1 | 1/2007 | Goossens | |
| 2010/0179259 | A1 * | 7/2010 | Guo et al. | 524/105 |
| 2010/0187465 | A1 * | 7/2010 | Guo et al. | 252/5 |
| 2013/0175060 | A1 * | 7/2013 | Guo et al. | 169/46 |
| 2013/0181158 | A1 | 7/2013 | Guo et al. | |

FOREIGN PATENT DOCUMENTS

| | | | |
|---|---|---|---|
| CN | 1052880 | A | 7/1991 |
| CN | 1064818 | A | 9/1992 |
| CN | 1238226 | A | 12/1999 |
| CN | 1322580 | A | 11/2001 |
| CN | 1481266 | A | 3/2004 |
| CN | 1600391 | A | 3/2005 |
| CN | 1695750 | A | 11/2005 |
| CN | 1713935 | A | 12/2005 |
| CN | 101327364 | A | 12/2008 |
| CN | 201260858 | A | 6/2009 |
| CN | 101822883 | A | 9/2010 |
| RU | 2076761 | C1 | 4/1997 |
| RU | 2091106 | C1 | 9/1997 |

OTHER PUBLICATIONS

"The Security Analysis of Gas Fire extinguishing System" (Fire Science and Technology 2002 21(5)) 4 pgs.

Linteries et al., "Flame Inhibition by Ferrocene, Alone and with CO2 and CF3H," Halon Options Technical Working Conference, pp. 129-140, May 2000.

Linteries et al., "Flame Inhibition by Ferrocene and Blends of Inert and Catalytic Agents," Proceedings of the Combustion Institute, vol. 28, pp. 2965-2972, May 2000.

Shou et al., "Fire safety analysis of gas fire extinguishing system," Jun. 2002, 3 pgs.

International Search Report for PCT Application No. PCT/CN2011/079429, dated Dec. 15, 2011 (5 pages).

Written Opinion for PCT Application No. PCT/CN2011/079429, dated Dec. 15, 2011 (10 pages).

Prosecution History from U.S. Appl. No. 13/824,103, dated Oct. 10, 2013 through Jul. 2, 2014, 31 pp.

Prosecution History from U.S. Appl. No. 13/824,123, dated Oct. 9, 2013 through Mar. 4, 2015, 86 pp.

Prosecution History from U.S. Appl. No. 13/824,142, dated Oct. 8, 2013 through Jun. 18, 2014, 34 pp.

* cited by examiner

*Primary Examiner* — Joseph D Anthony

(74) *Attorney, Agent, or Firm* — Shumaker & Sieffert, P.A.

(57) ABSTRACT

The present disclosure relates to a fire extinguishing composition generating fire extinguishing substance through high-temperature decomposition; the fire extinguishing composition includes a fire extinguishing material which can be decomposed to release substance with fire extinguishing properties during the heating process; the content of the fire extinguishing material is at least 80 wt %; a pyrotechnic agent is adopted as a heat source and a power source in a process of fire extinguishing; and the purpose of fire extinguishing is achieved by: igniting the pyrotechnic agent, generating a large quantity of fire substance from the fire extinguishing composition in the use of high temperature produced by burning pyrotechnic agent, and the fire substance sprays out together with the pyrotechnic agent. Compared with the traditional aerosol fire extinguishing systems, the gas fire extinguishing systems and the water type extinguishing systems, the present disclosure provides a more efficient and safer fire extinguishing composition.

14 Claims, No Drawings

FIRE EXTINGUISHING COMPOSITION GENERATING FIRE EXTINGUISHING SUBSTANCE THROUGH HIGH-TEMPERATURE DECOMPOSITION

This application is a continuation of U.S. patent application Ser. No. 13/824,123, filed Mar. 15, 2013 now abandoned, which is a 371 National Phase Application based on International Application PCT/CN2011/079429, filed Sep. 7, 2011, which claims priority to Chinese Application 201010285531.1, filed Sep. 16, 2010. The entire contents of each are incorporated by reference herein.

TECHNICAL FIELD

The present disclosure relates to the fire-fighting field, relating to a use of a fire extinguishing composition and a chemical fire extinguishing substance, and in particular to a fire extinguishing composition which can generate fire extinguishing substance through high-temperature decomposition.

BACKGROUND

Since the specific objectives of replacing the Halon fire extinguishing agent were proposed to each country by The Canada Montreal Convention in 1987, all the countries of the world were dedicated to the research of new fire extinguishing technologies; people have made great efforts in order to find a fire extinguishing technology which has high fire extinguishing efficiency and no environment pollution.

The gas fire extinguishing systems, the powder fire extinguishing systems, the water type fire extinguishing systems and the like, which are environmentally friendly, are widely used as the substitutes of the Halon fire extinguishing agent. The fire extinguishing mechanism of an inert gas fire extinguishing system, such as carbon dioxide, IG541 and the like, is mainly based on physical extinguishing, namely, smothering extinguishing by reducing the oxygen concentration in a fire area, such fire extinguishing method will easily threaten the safety of the individuals. The powder fire extinguishing system implements fire extinguishing via the process in which the sprayed powder contacts with the flame under the force of pressurized gas to generate the physical and chemical inhibition effect; the water spraying fire extinguishing system achieves the purpose of controlling the fire, inhibiting the fire and extinguishing the fire under triple roles of cooling, smothering and isolating thermal radiation of the water mist.

However, these fire extinguishing systems need to be stored under high pressure, not only causes larger volume, but also have the risks of physical explosion during storage process; the document "The Security Analysis of Gas Fire extinguishing System" (Fire Science and Technology 2002 21(5)) analyzes the risks of the gas fire extinguishing system, and enumerates the safety accidents caused by the storage pressure gas fire extinguishing system when in use.

In recent years, people have been researching the fire extinguishing substances which can replace Halon, wherein the Next Generation Fire Extinguishing Technology Project Group (NGP) of the Building and Fire Research Centre of the U.S. National Institute of Standards and Technology (NIST) did a large number of experimental researches in the aspect of finding new fire extinguishing substances, the process includes: heating nitrogen, carbon dioxide and CF3H gas, and then using the heated high-temperature gas to heat the test substances; the test substances are then decomposed under high temperature, which acts on the flame together with the gas; Through the experiments, people find that the products generated by heating and decomposing some test substances can obviously improve the fire-extinguishing effect of the nitrogen, carbon dioxide and $CF_3H$ gas (Halon Options Technical Working Conference, April 2001, Albuquerque, N. Mex., Suppression of cup-burner diffusion flames by super-effective chemical inhibitors and inert compounds; Combustion and Flame 129:221-238(2002) Inhibition of Premixed Methane Flame by Manganese and Tin Compounds, Halon Options Technical Working Conference May 2000, flame inhibition by ferrocene, alone and with $CO_2$ and $CF_3H$).

However, the researches of the project group stopped after the laboratory theoretical research, without practically applying the research findings in fire extinguishers.

The existing aerosol fire extinguishing agent mainly includes the S type and K type fire extinguishing agents, by comprehensively analyzing the performance characteristics, the disadvantages are mainly as follows: all the aerosol fire extinguishing agents use the fire extinguishing agents to generate an oxidation-reduction reaction, which releases a large number of gas and active particles, finally to achieve the chemical and physical combination fire-extinguishing purpose via the chain scission reaction of the active particles and the coverage smothering of the large number of gas. The aerosol fire extinguishing agent can release a large amount of heat while releasing the aerosol during the combustion reaction; in order to effectively lower the temperature of the device and the aerosol, and to avoid a secondary fire, a cooling system needs to be added, which causes complicated and heavy device structure, complicated technical process and high cost; because of the existence of the cooling system, a large number of active particles are inactivated, and the fire extinguishing performance is greatly reduced.

SUMMARY

Aiming at the current situations of the existing fire extinguishing devices, and in particular to the inherent defects of the aerosol fire extinguishing systems, the purpose of this present disclosure is to provide a fire extinguishing composition which needs no pressure storage, and is safer, more environmentally friendly and efficient. A fire extinguishing device is described comprising: a nozzle and a composition comprising a pyrotechnic agent and a fire extinguishing composition placed within the fire extinguishing device; the fire extinguishing composition is arranged above the pyrotechnic agent within the fire extinguishing device closer to the nozzle of the fire extinguishing device, the fire extinguishing composition generates fire extinguishing substance by high-temperature decomposition, wherein the fire extinguishing composition comprises: a fire extinguishing material which can be decomposed to release a fire extinguishing substance with fire extinguishing properties during a heating process, the content of the fire extinguishing material being at least 80 wt %; wherein the pyrotechnic agent is adopted as a heat source and a power source in a process of fire extinguishing, the pyrotechnic agent is a pyrotechnic aerosol fire extinguishing agent, and wherein fire extinguishing is achieved by: igniting the pyrotechnic agent, generating a large quantity of fire extinguishing substance from the fire extinguishing composition in the use of high temperature produced by burning pyrotechnic agent, and the fire extinguishing substance spraying out together with the pyrotechnic agent.

The fire extinguishing composition in the present disclosure, namely, the fire extinguishing composition generating fire extinguishing substance through high-temperature decomposition includes a fire extinguishing material which is capable of generating fire extinguishing substance through high-temperature decomposition, wherein the content thereof is more than 80 wt %.

Besides including the fire extinguishing material which is used as the main fire extinguishing material, and which can generate the fire extinguishing substance through high-temperature decomposition, the fire extinguishing composition in the present disclosure can also properly add various additives which are commonly used in the fire-fighting field.

The fire extinguishing composition for generating fire extinguishing substance through high-temperature decomposition in the present disclosure can achieve the following effects at the same time: first, the fire extinguishing composition capable of generating the fire extinguishing substance via high temperature decomposition can be decomposed to release the fire extinguishing substance at the moment of heating, so as to fulfill the target of fire extinguishing via using the physical or chemical inhibition effect, or the physical and chemical synergistic inhibition effect of the fire extinguishing substances; second, via the inhibition effect of the decomposition products, the fire extinguishing effectiveness of the fire extinguishing agent is further improved while reducing the after-combustion possibility of the fire source; third, the fire extinguishing composition can do heat absorption rapidly when decomposing under high-temperature heating, thus can effectively and rapidly reduce the heat released by burning the pyrotechnic agent, which greatly reduces the temperature of the nozzle of the fire extinguishing device and the sprayed substances, thus the complicated cooling system of the fire extinguishing device is not needed any more, and the risks of generating a secondary fire are removed; fourth, the fire extinguishing composition can be processed and molded easily, and can be independently used or matched with the physical coolant; fifth, the fire extinguishing composition has stable performance, and is easy to be stored for a long time; sixth, the fire extinguishing composition has low or no toxicity, is environment friendly and has excellent performance.

The fire extinguishing composition generating fire extinguishing substance through high-temperature decomposition in the present disclosure is described below in details.

The fire extinguishing composition in the present disclosure includes the fire extinguishing material generating the fire extinguishing substance through high-temperature decomposition, of which the content is more than 80 wt %.

The flame inhibition mechanism of the fire extinguishing composition for generating fire extinguishing substance through high-temperature decomposition is as follows:

The fire extinguishing composition can be decomposed to release the fire extinguishing substance under high-temperature; the fire extinguishing substance can have reactions with one or more of O, OH, H free radicals which are necessary for the chain combustion reaction via the free radicals, so as to cut off the chain combustion reaction; and also can reduce the partial pressure of oxygen via physical effect to inhibit the flames, or can simultaneously generate the physical and chemical inhibition effect to together realize the fire extinguishing effect; Meanwhile, it can generate synergistic interaction with the pyrotechnic agent to further improve the fire extinguishing effectiveness of the fire extinguishing agent, which greatly shorten the effective fire extinguishing time.

In order to guarantee the stable performance of the fire extinguishing composition under normal temperature, and to conveniently have long-term storage, the melting point of the fire extinguishing composition generating fire extinguishing substances through high-temperature decomposition is preferably more than 100 degrees centigrade, and can be: bromine-based fire extinguishing material, tetrabromobisphenol A, tetrabromobisphenol A ether, 1,2-bis(tribromophenoxy) ethane, N,N-ethylene-bis(tetrabromophthalimide), Dimethyl 4-bromophthalate, tetrabromo phthalic disodium, decabromodiphenyl ether, 1,4-Bis(pentabromophenoxy)tetrabromobenzene (ie.DBDPOB), 1,2-bis(pentabromophenyl) ethane, bromo trimethylphenyl indane, pentabromobenzyl acrylate (ie,BTMPI), hexabromo-benzene, pentabromotoluene, hexabromocyclododecane, N,N'-1,2-ethylene-bis(5,6-dibromonorbomane-2,3-dicarboximide) (ie.DEDBFA), pentabromo chlorocyclohexane, brominated styrene copolymer, tetrabromobisphenol A carbonate oligomer, poly(pentabromobenzyl acrylate) (ie, PPBBA), poly(dibromo phenylene ether); chlorine-based fire extinguishing material: dechlorane plus, chlorendic anhydride, perchloropentacyclodecan, tetrachlorobisphenol A, chlorinated polypropylene, chlorinated polyvinyl chloride, vinyl chloride-vinylidene chloride copolymer, chlorinated polyether; organophosphorus-based fire-extinguishing material: 1-oxo-4-hydroxymethyl-2,6,7-trioxa-1-phosphabicyclo [2,2,2] octane, 2,2-dimethyl-1,3-propanediyl-di(neopentyl glycolato) bisphosphate, 9,10-dihydro-9-oxa-10-phosphaphenanthrene-10 oxide, bis (4-carboxyphenyl) phenyl phosphine oxide, bis(4-hydroxyphenyl) phenyl phosphine oxide, phenyl phosphate diphenyl sulfone ester oligomer; phosphorus-halogen based fire-extinguishing material: tri(2,2-di(bromomethyl)-3-bromopropyl) phosphate, tri(dibromophenyl) phosphate, 3,9-bis(tribromophenoxy)-2,4,8,10-tetroxa-3,9-diphosphaspiro ring[5,5]-3,9-dioxide undecane, 3,9-bis(pentabromophenoxy)-2,4,8,10-tetroxa-3,9-diphosphaspiro ring[5,5]-3,9-dioxide undecane, 1-oxo-4-tribromophenyl oxycarbonyl-2,6,7-trioxa-1-phosphabicyclo[2,2,2] octane, p-phenylene tetra(2,4,6-tribromophenyl) bisphosphate, 2,2-dimethyl-1,3-propanediyl -di(neopentyl glycolato) bisphosphate, 2,9-di (tribromo neopentyloxy)-2,4,8,10-tetroxa-3,9-diphosphaspiro ring[5,5]-3,9-dioxide undecane; nitrogen-based and phosphorus-nitrogen based fire-extinguishing material: melamine cyanurate, melamine orthophosphate, dimelamine orthophosphate, melamine polyphosphate, melamine borate, melamine octamolybdate, tri-hydroxyethyl isocyanurate, 2,4-diamino-6-(3,3,3-trichloropropyl)-1,3,5-triazine, 2,4-di(N-hydroxymethylamino)-6-(3,3,3-trichloropropyl-1,3,5-triazine), phosphate dibasic guanidine, guanidinium dihydrogen phosphate, guanidine carbonate, guanidine sulfamate, urea, urea dihydrogen phosphate, dicyandiamide, bis(2,6,7-trioxa-1-phosphabicyclo [2,2,2] octane-1-oxy-4-methyl) hydroxy phosphate melamine, 3,9-dihydroxy-3,9-dioxy-2,4,8,10-tetroxa-3,9-diphosphaspiro ring[5,5] undecane-3,9-dimelamine, 1,2-di(2-oxy-5,5-dimethyl-1,3-dioxa-2-phosphorus heterocyclic hexyl-2-amino) ethane, N,N'-di(2-oxy-5,5-dimethyl-1,3-dioxa-2-phosphorus heterocyclic hexyl)-2,2'-m-phenylenediamine, tri(2-oxy-5,5-dimethyl-1,3-dioxa-2-heterocyclic hexyl-2-methyl) amine, phosphonitrilic chloride trimer; inorganic fire-extinguishing material: ammonium polyphosphate, diammonium hydrogen phosphate, ammonium dihydrogen phosphate, zinc phosphate, aluminium phosphate, boron phosphate, antimony trioxide, aluminium hydroxide, magnesium hydroxide, hydromagnesite, alkaline aluminum oxalate, zinc borate, barium metaborate, zinc oxide, zinc sulfide, zinc sulfate heptahydrate, aluminum borate whisker, ammonium octamolybdate, ammonium heptamolybdate, zinc stannate, tin oxide, ferrocene, ferric acetone, ferric oxide, ferroferric oxide, sodium tungstate, potassium hexafluorotitanate, potassium hexafluorozirconate, titanium dioxide, calcium carbonate, barium sulfate.

There are other chemical substances which have the decomposition temperature of more than 100 degrees centigrade, and can be composed to release the fire-extinguishing substances: sodium bicarbonate, potassium bicarbonate, cobalt carbonate, zinc carbonate, basic zinc carbonate, manganese carbonate, ferrous carbonate, strontium carbonate, potassium sodium carbonate hexahydrate, calcium carbonate, dolomite, basic copper carbonate, zirconium carbonate, beryllium carbonate, sodium sesquicarbonate, cerous carbonate, lanthanum carbonate, guanidine carbonate, lithium carbonate, scandium carbonate, vanadium carbonate, chromium carbonate, nickel carbonate, yttrium carbonate, silver carbonate, praseodymium carbonate, neodymium carbonate, samarium carbonate, europium carbonate, gadolinium carbonate, terbium carbonate, dysprosium carbonate, holmium carbonate, erbium carbonate, thulium carbonate, ytterbium carbonate, lutecium carbonate, aluminum hydroxyacetate, calcium acetate, sodium bitartrate, sodium acetate, potassium acetate, zinc acetate, strontium acetate, nickel acetate, copper acetate, sodium oxalate, potassium oxalate, ammonium oxalate, nickel oxalate, manganese oxalate dihydrate, iron nitride, sodium nitrate, magnesium nitrate, potassium nitrate, zirconium nitrate, monocalcium phosphate, sodium dihydrogen phosphate, sodium dihydrogen phosphate dihydrate, monopotassium phosphate, aluminium dihydrogen phosphate, ammonium dihydrogen phosphate, zinc dihydrogen phosphate, manganous dihydrogen phosphate, magnesium dihydrogen phosphate, disodium hydrogen phosphate, diammonium hydrogen phosphate, calcium hydrogen phosphate, magnesium hydrogen phosphate, ammonium phosphate, magnesium ammonium phosphate, ammonium polyphosphate, potassium metaphosphate, potassium tripolyphosphate, sodium trimetaphosphate, ammonium hypophosphite, ammonium orthophosphite di-hydrogen, manganese phosphate, di-zinc hydrogen phosphate, dimanganese hydrogen phosphate, guanidine phosphate, melamine phosphate salt, urea phosphate, hydrogen phosphate metaborate strontium, potassium, boric acid, ammonium pentaborate, potassium tetraborate.$8H_2O$, magnesium metaborate.$8H_2O$, ammonium tetraborate.$4H_2O$, strontium metaborate, strontium tetraborate, strontium tetraborate.$4H_2O$, sodium tetraborate.$10H_2O$, manganese borate, zinc borate, ammonium fluoroborate, ferrous ammonium sulfate, aluminum sulfate, aluminium potassium sulfate, aluminum ammonium sulfate, ammonium sulfate, magnesium hydrogen sulfate, aluminium hydroxide, magnesium hydroxide, ferric hydroxide, cobalt hydroxide, bismuth hydroxide, strontium hydroxide, cerium hydroxide, lanthanum hydroxide, molybdenum hydroxide, ammonium molybdate, zinc stannate, magnesium trisilicate, telluric acid, manganese tungstate, manganite, cobaltocene, 5-aminotetrazole, guanidine nitrate, azodicarbonamide, nylon powder, oxamide, biuret, pentaerythritol, decabromodiphenyl ether, tetrabromophthalic anhydride, dibromoneopentyl glycol, potassium citrate, sodium citrate, manganese citrate, magnesium citrate, copper citrate, ammonium citrate, nitroguanidine.

The fire extinguishing composition in the present disclosure also can add various additives as required, such as the stearate, graphite, combination solution of water soluble polymer or the mixture thereof, wherein the content of the additive is less than or equal to 20 wt %.

Each component of the fire extinguishing compositionin the present disclosure and the content thereof are preferably:

the fire extinguishing material: 80 wt % to 90 wt %, the additive: 10 wt % to 20 wt %.

The fire extinguishing composition in the present disclosure can be molded to be spherical, flake-like, strip-like, block-like and cellular shapes by using the techniques of pelleting, mould pressing, extruding and the like, and can be processed with surface coating treatment. Hydroxymethyl cellulose or hydroxyethyl cellulose is preferably added as the surface coating agent when implementing the surface coating treatment. The surface coating agent can improve the surface finish of the composition system, improve the intensity, abrasion resistance and shock resistance thereof, and prevent the accidents such as the fire-extinguishing composition is pulverized, has dropped dregs, and overflows from the fire extinguishing device during the transportation process.

The fire extinguishing composition in the present disclosure is described more specifically below via the embodiments.

DETAILED DESCRIPTION OF THE EMBODIMENTS

Respectively adding 30 g of the fire extinguishing composition prepared by the fire extinguishing material and the additives described in the following table into the fire extinguishing device which has already been filled with 20 g of the K type thermal aerosol generating agent, and respectively implementing fire extinguishing tests for a distributing fire in a 1.0 $m^3$ test box; respectively testing 3 rounds for each group of samples, recording the fire extinguishing quantity and the residual quantity; the test result is as shown in Table 1.

The comparison embodiments are that: implementing fire extinguishing tests for a distributing fire utilizing the fire extinguishing device samples which are only respectively filled with 20 g commercial and normal S type aerosol fire extinguishing agent or K type aerosol fire extinguishing agent in the same 1.0 $m^3$ test box, respectively testing 3 rounds for each group of the samples, recording the fire extinguishing quantity and the residual quantity, and the experimental test result is as shown in Table 1.

TABLE 1

| Ingredient and test result comparison | | | | | | | |
|---|---|---|---|---|---|---|---|
| | | Ingredient content of embodiments (mass percent) | | | | | |
| | Ingredient | 1 | 2 | 3 | 4 | 5 | 6 |
| Fireextinguishing material | Commercial S type fire extinguishing agent | | | | | | |
| | Commercial K type fire-extinguishing agent | | | | | | |
| | Pentabromotoluene | 80 | | | 20 | | |
| | hexabromocyclododecane | | 75 | | | | 5 |
| | Perchloropentacyclodecan | | | 75 | | | |

TABLE 1-continued

| Ingredient and test result comparison | | | | | | |
|---|---|---|---|---|---|---|
| Phenyl diphenyl phosphate oligomer | | | | 70 | | |
| Tri(2,2-di(bromomethyl)-3-bromopropyl)phosphate | 14 | 20 | | | 85 | |
| Melamine cyanurate | | | | | 10 | 70 |
| Melamine orthophosphate | | | | | | |
| Guanidine carbonate | | | 15 | | | 10 |
| Urea | | | 5 | 5 | | 10 |
| Magnesium stearate | 3 | 3 | 2.5 | 2 | 2 | 2 |
| Sodium silicate | | | | 1 | | 1 |
| Surface coating agent | | | | | | |
| Hydroxyethyl cellulose | 3 | 2 | 2.5 | 2 | 3 | 2 |
| Test result comparison | | | | | | |
| Fire extinguishing situation | Four fire extinguished | Four fire extinguished | Three fire extinguished | Three fire extinguished | Four fire extinguished | Four fire extinguished |
| Residual quantity % | 29.1 | 26.8 | 31.4 | 33.4 | 27.9 | 25.3 |

| | | Ingredient content of embodiments (mass percent) | | | Comparison embodiment | |
|---|---|---|---|---|---|---|
| | Ingredient | 7 | 8 | 9 | 1 | 2 |
| Fireextinguishing material | Commercial S type fire extinguishing agent | | | | ✓ | |
| | Commercial K type fire-extinguishing agent | | | | | ✓ |
| | Pentabromotoluene hexabromocyclododecane | 25 | | | | |
| | Perchloropentacyclodecan | | 10 | | | |
| | Phenyl diphenyl phosphate oligomer | | | 10 | | |
| | Tri(2,2-di(bromomethyl)-3-bromopropyl)phosphate | | | | | |
| | Melamine cyanurate | | | | | |
| | Melamine orthophosphate | 65 | | 10 | | |
| | Guanidine carbonate | | 80 | | | |
| | Urea | | 5 | 70 | | |
| | Magnesium stearate | 3 | 2.5 | 3 | | |
| | Sodium silicate | | 5 | 4 | | |
| Surface coating agent | | | | | | |
| Hydroxyethyl cellulose | | 2 | 2.5 | 3 | | |
| Test result comparison | | | | | | |
| Fire extinguishing situation | | Three fire extinguished | Three fire extinguished | Three fire extinguished | Two fire extinguished | Two fire extinguished |
| Residual quantity % | | 28.1 | 32.6 | 30.1 | 46.7 | 46.7 |

The fire extinguishing performance in the above table is the least fire extinguishing numbers of the three tests which are implemented, the residual quantity is the average residual quantity of the three experiments; from the test results in the above table, it can be seen that the fire-extinguishing performances of the fire-extinguishing compositions of the embodiments 1-9 in the present disclosure are all superior to the comparison embodiments 1 and 2 when implementing the fire extinguishing test for a distributing fire in the 1.0 $m^3$ test box, and the residual quantities are all smaller than the comparison embodiments 1 and 2.

The experimental method is based on the concentration distribution test method of 7.13 in GA 499-2004, the fire-extinguishing test is implemented in the 1 $m^3$ test box; five steel-made test tanks are placed in the test box; four fuel tanks are respectively placed in four corners of the experimental spaces, which are staggered up and down in pairs; in addition, a fuel tank is put at the bottom of the experimental space behind the baffle plate. N-heptane is filled in the fuel tank, and the bottom of the tank uses clear water as a cushion layer.

The above specific embodiments are only examples; under the above instructions of the present disclosure, those skilled in the art can implement various improvements and deformations on the basis of the above embodiments; and all the improvements or deformations shall fall within the protection scope of the present disclosure. Those skilled in the art should know that, the above specific descriptions are only used for explaining the purposes of the present disclosure, without limiting the present disclosure.

Various embodiments of the invention have been described. These and other embodiments are within the scope of the following claims.

The invention claimed is:

1. A fire extinguishing device wherein the fire extinguishing device comprising:

a nozzle; and a composition comprising a pyrotechnic agent and a fire extinguishing composition placed within the fire extinguishing device;

the fire extinguishing composition is arranged above the pyrotechnic agent within the fire extinguishing device closer to the nozzle of the fire extinguishing device, the fire extinguishing composition generates fire extinguishing substance by high-temperature decomposition, wherein the fire extinguishing composition comprises: a fire extinguishing material which can be decomposed to release a fire extinguishing substance with fire extinguishing properties during a heating process, the content of the fire extinguishing material being at least 80 wt %;

wherein the pyrotechnic agent is adopted as a heat source and a power source in a process of fire extinguishing, the pyrotechnic agent is a pyrotechnic aerosol fire extinguishing agent, and wherein fire extinguishing is achieved by:

igniting the pyrotechnic agent, generating a large quantity of fire extinguishing substance from the fire extinguishing composition in the use of high temperature produced by burning pyrotechnic agent, and the fire extinguishing substance spraying out together with the pyrotechnic agent.

2. The fire extinguishing device according to claim 1, wherein the fire extinguishing material is a composition which has a melting point of more than 100 degrees centigrade, and can be decomposed into fire extinguishing substance.

3. The fire extinguishing device according to claim 1, wherein the composition comprises a bromine-based fire extinguishing material, a chlorine-based fire extinguishing material, an organophosphorus-based fire extinguishing material, a phosphorus-halogen based fire extinguishing material, a nitrogen-based and phosphorus-nitrogen based fire extinguishing material or an inorganic fire extinguishing material.

4. The fire extinguishing device according to claim 3, wherein the bromine-based fire extinguishing material is tetrabromobisphenol A, tetrabromobisphenol A ether, 1,2-bis (tribromophenoxy) ethane, tetrabromophthalic anhydride, N,N-ethylene-bis(tetrabromophthalimide, decabromodiphenyl ether, 1,4-Bis(pentabromophenoxy)tetrabromobenzene, 1,2-bis(pentabromophenyl) ethane, bromo trimethylphenyl indane, pentabromobenzyl acrylate, hexabromo-benzene, pentabromotoluene, hexabromocyclododecane, N,N'-1,2-ethylene-bis(5,6-dibromonorbomane-2,3-dicarboximide), brominated styrene copolymer, tetrabromobisphenol A carbonate oligomer, polypentabromobenzyl acrylate or polydibromo phenylene ether.

5. The fire extinguishing device according to claim 3, wherein the chlorine-based fire extinguishing material is dechlorane plus, chlorendic anhydride, perchloropentacyclodecan, tetrachlorobisphenol A, chlorinated polypropylene, chlorinated polyvinyl chloride, vinyl chloride-vinylidene chloride copolymer or chlorinated polyether.

6. The fire extinguishing device according to claim 3, wherein the organophosphorus-based fire extinguishing material is 1-oxo-4-hydroxymethyl-2,6,7-trioxa-1-phosphabicyclo [2,2,2] octane, 2,2-dimethyl-1,3-propanediyl -di (neopentyl glycolato) bisphosphate, 9,10-dihydro-9-oxa-10-phosphaphenanthrene-10 oxide, bis(4-carboxyphenyl) phenyl phosphine oxide, bis(4-hydroxyphenyl) phenyl phosphine oxide or phenyl phosphate diphenyl sulfone ester oligomer.

7. The fire extinguishing device according to claim 3, wherein the phosphorus-halogen based fire extinguishing material is tri(2,2-di bromomethyl-3-bromopropyl) phosphate, tri(dibromophenyl) phosphate, 3,9-di(tribromophenoxy)-2,4,8,10-tetroxa-3,9-diphosphaspiro ring[5,5]-3,9-dioxide undecane, 3,9-di(pentabromophenoxy)-2,4,8,10-tetroxa-3,9-diphosphaspiro ring[5,5]-3,9-dioxide undecane, 1-oxo-4-tribromophenyl oxycarbonyl-2,6,7-trioxa-1-phosphabicyclo [2,2,2] octane, p-phenylene tetra(2,4,6-tribromophenyl) bisphosphate, 2,2-dimethyl-1,3-propanediyl -di (neopentyl glycolato) bisphosphate or 3,9-di(tribromo neopentyloxy)-2,4,8,10-tetroxa-3,9-diphosphaspiro ring[5,5]-3,9-dioxide undecane.

8. The fire extinguishing device according to claim 3, wherein the nitrogen-based and phosphorus-nitrogen based fire extinguishing material is melamine cyanurate, melamine orthophosphate, dimelamine orthophosphate, melamine polyphosphate, melamine borate, melamine octamolybdate, tri-hydroxyethyl isocyanurate, 2,4-diamino-6-(3,3,3-trichloropropyl)-1,3,5-triazine, 2,4-di(N-hydroxymethylamino)-6-(3,3,3-trichloropropyl-1,3,5-triazine), phosphate dibasic guanidine, guanidinium dihydrogen phosphate, guanidine carbonate, guanidine sulfamate, urea, urea dihydrogen phosphate, dicyandiamide, bis(2,6,7-trioxa-1-phospha-bicyclo[2,2,2] octane-1-oxy-4-methyl) hydroxy phosphate melamine, 3,9-dihydroxy-3,9-dioxy-2,4,8,10-tetroxa-3,9-diphosphaspiro ring[5,5] undecane-3,9-dimelamine, 1,2-di(2-oxy-5,5-dimethyl-1,3-dioxa-2-phosphorus heterocyclic hexyl-2-amino) ethane, N,N'-di(2-oxy-5,5-dimethyl-1,3-dioxa-2-phosphorus heterocyclic hexyl)-2,2'-m-phenylenediamine, tri(2-oxy-5,5-dimethyl-1,3-dioxa-2-heterocyclic hexyl-2-methyl) amine or phosphonitrilic chloride trimer.

9. The fire extinguishing device according to claim 3, wherein the inorganic fire extinguishing material is ammonium polyphosphate, diammonium hydrogen phosphate, ammonium dihydrogen phosphate, zinc phosphate, aluminium phosphate, boron phosphate, antimony trioxide, aluminium hydroxide, magnesium hydroxide, hydromagnesite, alkaline aluminum oxalate, zinc borate, barium metaborate, zinc oxide, zinc sulfide, zinc sulfate heptahydrate, aluminum borate whisker, ammonium octamolybdate, ammonium heptamolybdate, zinc stannate, tin oxide, ferrocene, ferric acetone, ferric oxide, ferroferric oxide, sodium tungstate, potassium hexafluorotitanate, potassium hexafluoro zirconate, titanium dioxide, calcium carbonate or barium sulfate.

10. The fire extinguishing device according to claim 1, wherein the composition also can comprises sodium bicarbonate, potassium bicarbonate, cobaltous carbonate, zinc carbonate, basic zinc carbonate, manganese carbonate, ferrous carbonate, strontium carbonate, potassium sodium carbonate hexahydrate, calcium carbonate, dolomite, basic copper carbonate, zirconium carbonate, beryllium carbonate, sodium sesquicarbonate, cerous carbonate, lanthanum carbonate, guanidine carbonate, lithium carbonate, scandium carbonate, vanadium carbonate, chromium carbonate, nickel carbonate, yttrium carbonate, silver carbonate, praseodymium carbonate, neodymium carbonate, samarium carbonate, europium carbonate, gadolinium carbonate, terbium carbonate, dysprosium carbonate, holmium carbonate, erbium carbonate, thulium carbonate, ytterbium carbonate, lutecium carbonate, aluminum hydroxyacetate, calcium acetate, sodium bitartrate, sodium acetate, potassium acetate, zinc acetate, strontium acetate, nickel acetate, copper acetate, sodium oxalate, potassium oxalate, ammonium oxalate, nickel oxalate, manganese oxalate dihydrate, iron nitride, sodium nitrate, magnesium nitrate, potassium nitrate, zirconium nitrate, monocalcium phosphate, sodium dihydrogen phosphate, sodium dihydrogen phosphate dihydrate, monopotassium phosphate, aluminium dihydrogen phosphate, ammonium dihydrogen phosphate, zinc dihydrogen phosphate, manganese dihydrogen phosphate, magnesium dihydrogen phosphate, disodium hydrogen phosphate, diammonium hydrogen phosphate, calcium hydrogen phosphate, magnesium hydrogen phosphate, ammonium phosphate, magnesium ammonium phosphate, ammonium polyphosphate, potassium metaphosphate, potassium tripolyphosphate, sodium trimetaphosphate, ammonium hypophosphite, ammonium orthophosphite di-hydrogen, manganese phosphate, di-zinc hydrogen phosphate, dimanganese hydrogen phosphate, guanidine phosphate, melamine phosphate salt, urea phosphate, hydrogen phosphate metaborate strontium, hydrogen phosphate strontium metaborate potassium, boric acid, ammonium pentaborate, potassium tetraborate.$8H_2O$, magnesium metaborate.$8H_2O$, ammonium tetraborate.$4H_2O$, strontium metaborate, strontium tetraborate, strontium tetraborate.$4H_2O$, sodium tetraborate.$10H_2O$, manganese borate, zinc borate, ammonium fluoroborate, ferrous ammonium sulfate, aluminum sulfate, aluminium potassium sulfate, aluminum ammonium sulfate, ammonium sulfate, magnesium hydrogen sulfate, aluminium hydroxide, magnesium hydroxide, ferric hydroxide, cobalt hydroxide, bismuth hydroxide, strontium hydroxide, cerium hydroxide, lanthanum hydroxide, molybdenum hydroxide, ammonium molybdate, zinc stannate, magnesium trisilicate, telluric acid, manganese tungstate, manganite, cobaltocene, 5-aminotetrazole, guanidine nitrate, azodicarbonamide, nylon powder, oxamide, biuret, pentaerythritol, decabromodiphenyl ether, tetrabromophthalic anhydride, dibromoneopentyl glycol, potassium citrate, sodium citrate, manganese citrate, magnesium citrate, copper citrate, ammonium citrate or nitroguanidine.

11. The fire extinguishing device according to claim 3, wherein the fire extinguishing composition also includes an additive, of which the content is less than or equal to 20 wt %.

12. The fire extinguishing device according to claim 11, wherein the additive is stearate, graphite, combination solution of water soluble polymer or the mixture thereof.

13. The fire extinguishing device according to claim 11, wherein: each component of the fire extinguishing composition and the content thereof are:

the fire extinguishing material: 80 wt % to 90 wt %, the additive: 10 wt % to 20 wt %.

14. The fire extinguishing device according to claim 1, wherein: the fire extinguishing composition is implemented with a surface coating treatment.

* * * * *